US011217144B2

(12) United States Patent
Ahn et al.

(10) Patent No.: US 11,217,144 B2
(45) Date of Patent: Jan. 4, 2022

(54) DRIVER INTEGRATED CIRCUIT AND DISPLAY DEVICE INCLUDING THE SAME

(71) Applicant: SILICON WORKS CO., LTD., Daejeon (KR)

(72) Inventors: Yong Sung Ahn, Daejeon (KR); Sung Ha Kim, Daejeon (KR); Goon Seok Oh, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 0 days.

(21) Appl. No.: 17/086,656

(22) Filed: Nov. 2, 2020

(65) Prior Publication Data

US 2021/0134205 A1 May 6, 2021

(30) Foreign Application Priority Data

Nov. 6, 2019 (KR) ..... 10-2019-0141110
Oct. 12, 2020 (KR) ..... 10-2020-0130816

(51) Int. Cl.
*G09G 3/20* (2006.01)

(52) U.S. Cl.
CPC ..... *G09G 3/20* (2013.01); *G09G 2310/027* (2013.01); *G09G 2310/0286* (2013.01); *G09G 2310/0289* (2013.01); *G09G 2310/0291* (2013.01)

(58) Field of Classification Search
CPC ..... G09G 3/20; G09G 2310/0286; G09G 2310/027; G09G 2310/0291; G09G 2310/0289; G09G 3/2092; G09G 2300/0408; G09G 2300/0426
See application file for complete search history.

(56) References Cited

U.S. PATENT DOCUMENTS 9,557,616 B2 * 1/2017 Chung ..... H05K 1/148
2012/0038614 A1 * 2/2012 Mizumaki ..... G09G 3/3614 345/211
2013/0009933 A1 * 1/2013 Toyomura ..... G09G 3/3225 345/211
2015/0060968 A1 3/2015 Sa et al.
2016/0182842 A1 6/2016 Mabuchi
2016/0254213 A1 9/2016 Kim
2016/0300875 A1 10/2016 Won et al.
2017/0235374 A1 * 8/2017 Arima ..... G06F 3/0446 345/174
2017/0352392 A1 12/2017 Lee et al.
(Continued)

FOREIGN PATENT DOCUMENTS

KR 10-2006-0135376 A 12/2006
KR 10-2015-0063824 A 6/2015

*Primary Examiner* — Andrew Sasinowski
(74) *Attorney, Agent, or Firm* — Harness, Dickey & Pierce, P.L.C.

(57) ABSTRACT

A driver integrated circuit (IC) according to one embodiment of the present disclosure includes a first IC, a second IC that is combined with the first IC, a first circuit configured to receive first image data, and generate second image data by correcting the first image data, a second circuit configured to sample the second image data, and a third circuit configured to convert the sampled second image data into a source signal, wherein the first circuit is mounted on the first IC, the second circuit is mounted on one of the first IC and the second IC, and the third circuit is mounted on the second IC.

17 Claims, 7 Drawing Sheets

(56) References Cited

U.S. PATENT DOCUMENTS

| | | | | |
|---|---|---|---|---|
| 2018/0301443 | A1 | 10/2018 | Kim et al. | |
| 2019/0114976 | A1* | 4/2019 | Ikeda | G09G 3/20 |
| 2019/0148285 | A1 | 5/2019 | Hong | |
| 2019/0265858 | A1* | 8/2019 | Nishio | G06F 3/0354 |

* cited by examiner

DRIVER INTEGRATED CIRCUIT AND DISPLAY DEVICE INCLUDING THE SAME

CROSS-REFERENCE TO RELATED APPLICATIONS

This application claims the benefit of the Korean Patent Applications No. 10-2019-0141110 filed on Nov. 6, 2019 and No. 10-2020-0130816 filed on Oct. 12, 2020, which are hereby incorporated by reference as if fully set forth herein.

FIELD

The present disclosure relates to a driver integrated circuit (IC) and a display device including the same.

BACKGROUND

With development into an information society, various demands are increasing for display devices for displaying images. Thus, recently, various types of display devices such as a liquid crystal display (LCD) device or an organic light-emitting display device are being utilized.

Display devices include a display panel and a driver integrated circuit (IC). The display panel is composed of a plurality of pixels arranged in a matrix form, and each of the pixels is composed of subpixels of red (R), green (G), blue (B), and the like. In addition, each of the pixels or each of the subpixels emits light in grayscale according to an image, thereby displaying the image on the entire display panel.

Display data indicating the grayscale value of each pixel or each subpixel is transmitted to the display panel using the driver IC.

SUMMARY

The present disclosure is directed to providing a driver integrated circuit (IC) capable of being miniaturized and a display device including the same.

The present disclosure is also directed to providing a driver IC capable of minimizing loss of image data and a display device including the same.

The present disclosure is also directed to providing a driver IC capable of minimizing wiring for image data and a display device including the same.

The present disclosure is also directed to providing a driver IC manufactured through a wafer-on-wafer process and a display device including the same.

According to an aspect of the present disclosure, there is provided a driver IC including a first IC, a second IC that is combined with the first IC, a first circuit configured to receive first image data and generate second image data by correcting the first image data, a second circuit configured to sample the second image data, and a third circuit configured to convert the sampled second image data into a source signal, wherein the first circuit is mounted on the first IC, the second circuit is mounted on one of the first IC and the second IC, and the third circuit is mounted on the second IC.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION

Figure 1:
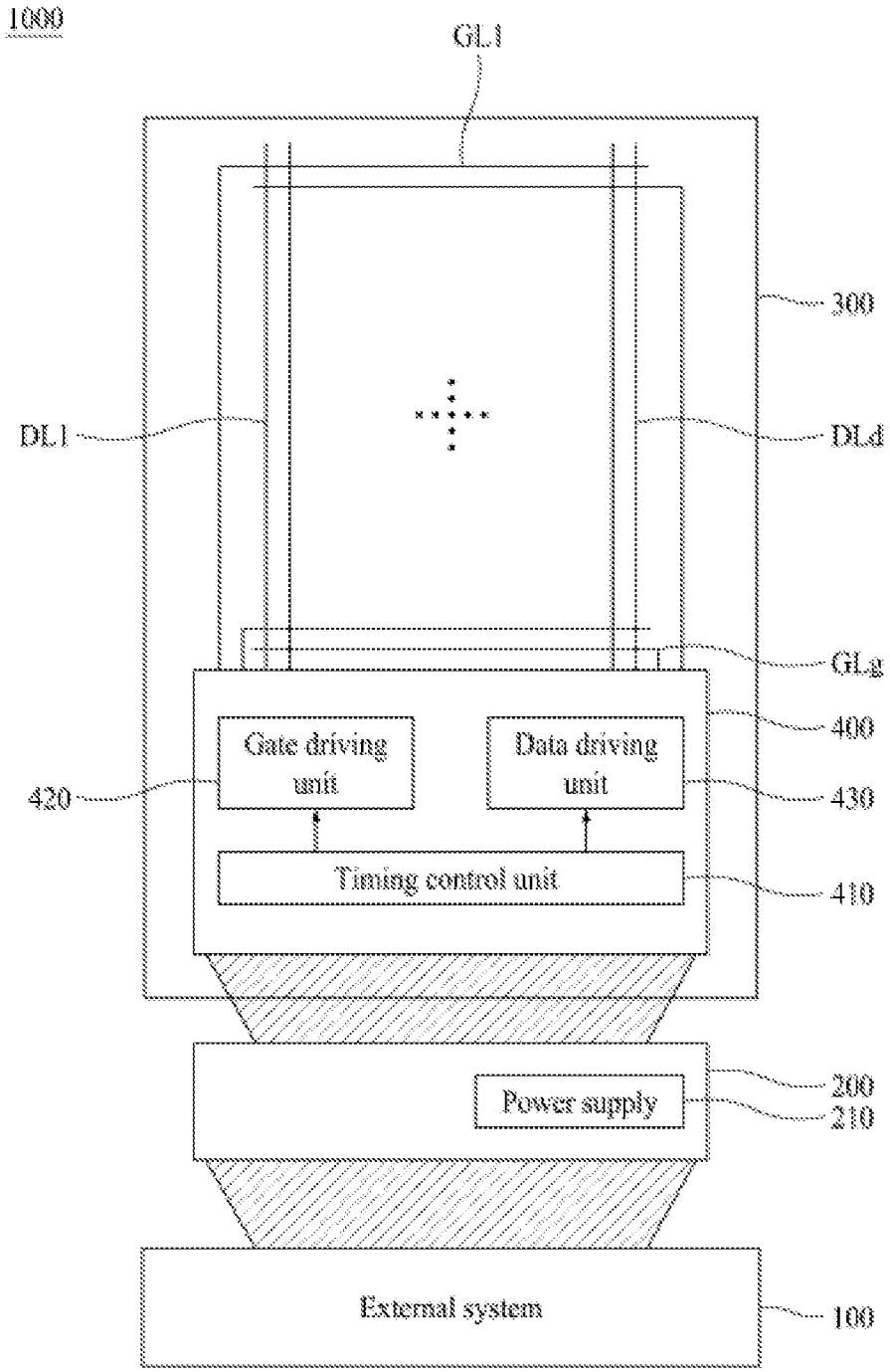
FIG. 1 is a diagram illustrating a display device to which a driver integrated circuit (IC) according to one embodiment of the present disclosure is applied.

In the specification, it should be noted that like reference numerals already used to denote like elements in other drawings are used for elements wherever possible. In the following description, when a function and a configuration known to those skilled in the art are irrelevant to the essential configuration of the present disclosure, their detailed descriptions will be omitted. The terms described in the specification should be understood as follows.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted.

In a case where 'comprise', 'have', and 'include' described in the present specification are used, another part may be added unless 'only' is used. The terms of a singular form may include plural forms unless referred to the contrary.

In construing an element, the element is construed as including an error range although there is no explicit description.

In describing a position relationship, for example, when a position relation between two parts is described as 'on~', 'over~', 'under~', and 'next~', one or more other parts may be disposed between the two parts unless 'just' or 'direct' is used.

In describing a time relationship, for example, when the temporal order is described as 'after~', 'subsequent~', 'next~', and 'before~', a case which is not continuous may be included unless 'just' or 'direct' is used.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

An X axis direction, a Y axis direction, and a Z axis direction should not be construed as only a geometric relationship where a relationship therebetween is vertical, and may denote having a broader directionality within a scope where elements of the present disclosure operate functionally.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

Hereinafter, embodiments of the present disclosure will be described in detail with reference to the drawings.

FIG. 1 is a diagram illustrating a display device to which a driver integrated circuit (IC) according to one embodiment of the present disclosure is applied. A display device 1000 according to the present disclosure includes an external system 100, a main board 200, a display panel 300, and a driver IC 400.

The display device 1000 may be a large-sized terminal such as a television (TV) or a personal computer (PC) and may be a mobile terminal such as a smart phone or cell phone, a tablet PC, or the like.

The external system 100 may transmit display data (e.g., image data, video data, or still image data) to be displayed to the driver IC 400. The display data may be divided into units of line data corresponding to horizontal lines of the display panel 300.

When the display device 1000 according to the present disclosure is a smart phone, the external system 100 may be an application processor (AP) that wirelessly communicates with an external communication network to receive audio or data.

A power supply 210 and various circuit elements may be mounted on the main board 200.

The power supply 210 supplies voltages for driving the display panel 300 and the driver IC 400. Specifically, the power supply 210 generates the voltages according to a driving voltage of each of circuits included in the driver IC 400, supplies the voltages to each of the circuits, and supplies power for driving the display panel 300.

The display panel 300 may be an organic light-emitting panel in which organic light-emitting diodes are formed, and may be a liquid crystal panel in which liquid crystals are formed. That is, all types of panels currently being used may be applied as the display panel 300 applied to the present disclosure. Thus, the display device according to the present disclosure may also include an organic light-emitting display device, a liquid crystal display device, and various other types of display devices. However, for convenience of description, as an example of the present disclosure, hereinafter, the display device is described as being a liquid crystal display device. Accordingly, in the following description, a case in which the display panel 300 is a liquid crystal panel will be described as an example of the present disclosure.

In the case in which the display panel 300 is a liquid crystal panel, a plurality of data lines DL1 to DLd, a plurality of gate lines GL1 to GLg intersecting the data lines, a plurality of thin-film transistors (TFTs) formed at intersections of the data lines and the gate lines, a plurality of pixel electrodes for charging data voltages to pixels, and a common electrode for driving liquid crystals, which are filled in a liquid crystal layer, together with the pixel electrodes are formed on a lower glass substrate of the display panel 300, and the pixels are arranged in a matrix form due to an intersection structure of the data lines and the gate lines.

A black matrix BM and a color filter are formed on an upper glass substrate of the display panel 300. The liquid crystals are filled between the lower glass substrate and the upper glass substrate.

As a liquid crystal mode of the display panel 300 applied to the present disclosure, not only a twisted nematic (TN) mode, a vertical alignment (VA) mode, an in-plane switching (IPS) mode, and a fringe field switch (FFS) mode, but also any kind of liquid crystal mode may be used. In addition, the display device 1000 according to the present disclosure may be implemented in any form, such as a transmissive type liquid crystal display device, a semi-transmissive type liquid crystal display device, a reflective type liquid crystal display device, or the like.

The display panel 300 displays images in response to gate signals and source signals, which are output from the driver IC 400.

The driver IC 400 may be composed of a timing control unit 410 configured to control a gate driving unit 420 and a data driving unit 430 which are formed on the display panel 300, the gate driving unit 420 configured to control signals input through the gate lines, and the data driving unit 430 configured to control signals input through the data lines formed on the display panel 300.

As shown in FIG. 1, the driver IC 400 may be mounted on the display panel 300, but the present disclosure is not limited thereto, and the driver IC 400 may be mounted on a separate board to be separated from the display panel 300.

Further, the timing control unit 410, the gate driving unit 420, and the data driving unit 430 may be formed individually as shown in FIG. 1, or formed in a single chip package.

Hereinafter, each component of the driver IC 400 will be described in more detail with reference to FIGS. 2 and 3.

Figure 2:
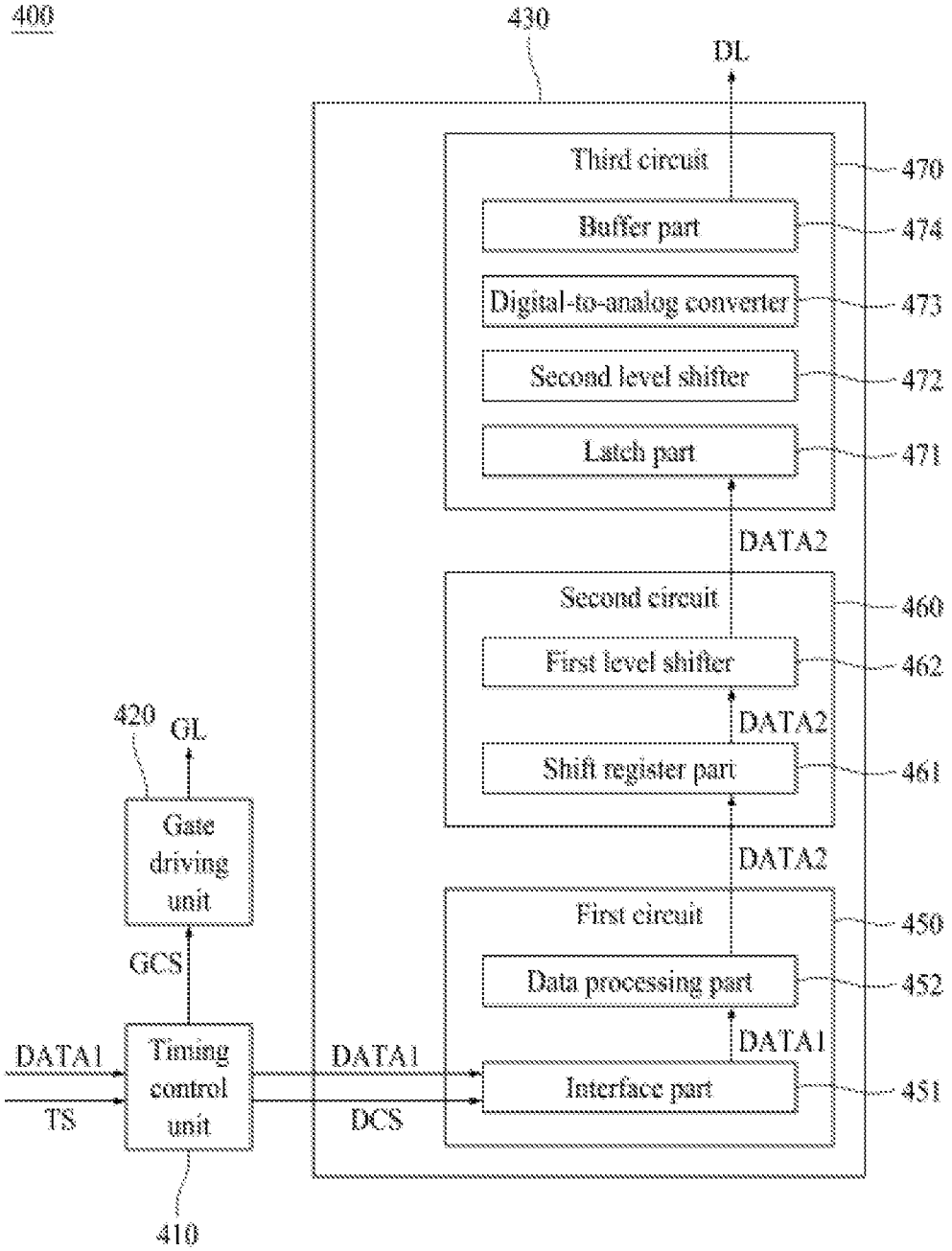
FIG. 2 is a schematic block diagram of the driver IC according to one embodiment of the present disclosure.
Figure 3:
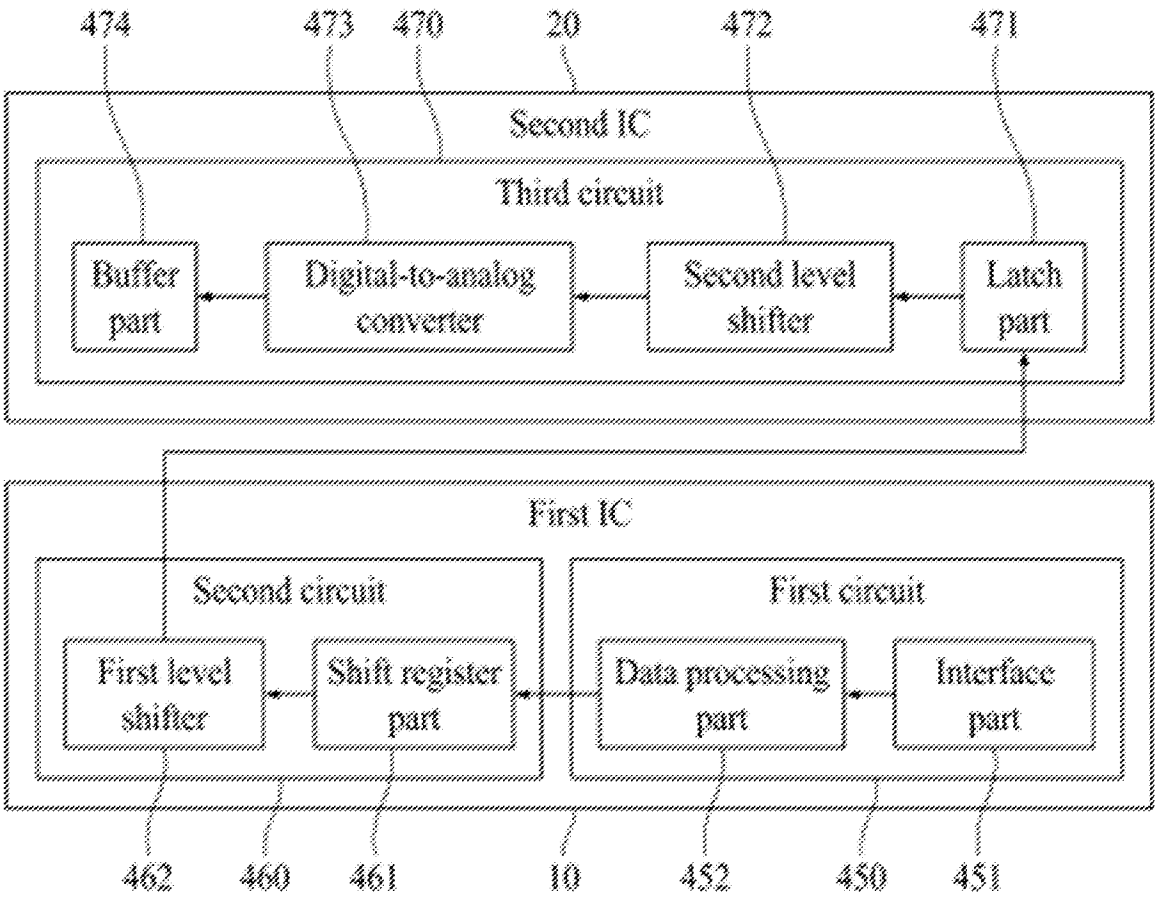
FIG. 3 is a diagram illustrating a structure of a data driving unit of the driver IC according to one embodiment of the present disclosure.

FIG. 2 is a schematic block diagram of the driver IC according to one embodiment of the present disclosure, and FIG. 3 is a diagram illustrating a structure of a data driving unit of the driver IC according to one embodiment of the present disclosure.

As shown in FIG. 2, the driver IC 400 includes the timing control unit 410, the gate driving unit 420, and the data driving unit 430.

The timing control unit 410 receives first image data DATA1 and timing signals TS from the external system 100, and generates a gate control signal GCS for controlling the gate driving unit 420, and a data control signal DCS for controlling the data driving unit 430, according to the timing signals TS. Here, the gate control signal GCS includes a gate start pulse GSP, a gate shift clock GSC, a gate output enable signal GOE, and the like, and the data control signal DCS includes a source start pulse SSP, a source sampling clock SSC, a source output enable signal SOE, and the like.

The timing control unit 410 transmits the gate control signal GCS to the gate driving unit 420 and transmits the data control signal DCS to the data driving unit 430.

The timing control unit 410 arranges the first image data DATA1 received from the external system 100. Specifically, the timing control unit 410 arranges the first image data DATA1 to match the structure and characteristics of the display panel 300. The timing control unit 410 transmits the arranged first image data DATA1 to the data driving unit 430.

The gate driving unit 420 outputs the gate signals, which are synchronized with the source signals generated by the data driving unit 430, to the gate lines in response to the gate control signal GCS generated by the timing control unit 410. Specifically, the gate driving unit 420 outputs the gate signals, which are synchronized with the source signals according to the gate start pulse, the gate shift clock, and the gate output enable signal that are generated by the timing control unit 410, to the gate lines.

The gate driving unit 420 includes a gate shift register, a gate level shifter, and the like. Here, the gate shift register may be formed directly on a TFT array substrate of the display panel 300 by a gate-in-panel (GIP) process. In this case, the gate driving unit 420 supplies the gate start pulse and the gate shift clock to the gate shift register that is formed on the TFT array substrate by a GIP process.

The data driving unit 430 converts the first image data DATA1 into the source signals according to the data control signal DCS generated by the timing control unit 410. Specifically, the data driving unit 430 converts the first image data DATA1 into the source signals according to the source start pulse, the source sampling clock, and the source output enable signal. The data driving unit 430 outputs the source signals corresponding to one horizontal line to the data lines every one horizontal period at which the gate signals are supplied to the gate lines.

Here, the data driving unit 430 receives a gamma voltage from a gamma voltage generator (not shown) and converts the first image data into the source signals using the gamma voltage.

According to one embodiment of the present disclosure, as shown in FIG. 2, the data driving unit 430 includes a first circuit 450, a second circuit 460, and a third circuit 470.

According to one embodiment of the present disclosure, as shown in FIGS. 2 and 3, the data driving unit 430 includes the first circuit 450 located in a first IC 10, the second circuit 460 located in the first IC 10, and the third circuit 470 located in a second IC 20.

The driver IC 400 according to the present disclosure may be manufactured through a wafer-on-wafer process. In comparison with a case in which the driver IC 400 is manufactured with one wafer, in the present disclosure, circuits of the driver IC 400 are divided and formed in a first wafer and a second wafer, and both wafers are combined to manufacture the driver IC 400, so that the number of required masks is reduced, thereby reducing costs. As described above, since the driver IC according to the present disclosure is manufactured through the wafer-on-wafer process, the circuits are divided and formed in two ICs.

Further, according to one embodiment of the present disclosure, as shown in FIG. 3, the first IC 10 and the second IC 20 may be combined with each other. Specifically, the first IC 10 and the second IC 20 may be combined by a method such as wire bonding using a wire, flip-chip bonding in which the connection is made through bumps, through-silicon-via (TSV) bonding, and the like. Accordingly, since the circuits constituting the driver IC 400 are formed in two ICs 10 and 20, and the first IC 10 and the second IC 20 are combined, the driver IC may be miniaturized.

According to one embodiment of the present disclosure, the data driving unit 430 includes the first circuit 450 configured to receive and process the first image data DATA1 to generate second image data DATA2, the second circuit 460 configured to sample the second image data DATA2 using the data control signal DCS, and the third circuit 470 configured to convert the sampled second image data DATA2 into the source signals.

The first circuit 450 receives and processes the first image data DATA1 to generate the second image data DATA2, and transmits the generated second image data DATA2 to the second circuit 460.

According to one embodiment of the present disclosure, the first circuit 450 includes an interface part 451 and a data processing part 452.

The interface part 451 may perform interfacing on signals and/or data which are transmitted and received between the timing control unit 410 and the data processing part 452. Specifically, the interface part 451 performs interfacing after receiving the first image data DATA1 transmitted from the timing control unit 410 and transmits the interfaced first image data DATA1 to the data processing part 452. Here, the first image data DATA1 may be R, G, and B data.

The interface part 451 may be an interface suitable for a serial interface, such as a Mobile Industry Processor Interface (MIPI®), a mobile display digital interface (MDDI), a DisplayPort, or an embedded DisplayPort (eDP).

The data processing part 452 generates the second image data DATA2 by correcting the first image data DATA1 transmitted from the interface part 451. In this case, the generated second image data DATA2 may be image data allowing the image quality of the display panel to be improved in comparison with the first image data DATA1. The data processing part 452 transmits the generated second image data DATA2 to a shift register part 461 of the second circuit 460.

According to one embodiment of the present disclosure, the data processing part 452 calculates checksum data CHKSUM for the second image data DATA2 and transmits the checksum data to the second circuit 460. The checksum data CHKSUM will be described in detail below with reference to FIG. 4. According to one embodiment of the present disclosure, the loss of the image data may be minimized by correcting errors occurring during the transmission process of the image data using the checksum data CHKSUM.

The second circuit 460 receives the second image data DATA2 and the data control signal DCS and outputs a sampling signal.

According to one embodiment of the present disclosure, the second circuit 460 includes the shift register part 461 and a level shifter 462.

The shift register part 461 controls the timing at which the second image data DATA2 is sequentially stored in a latch part 471 of the third circuit 470. Specifically, the shift register part 461 outputs the sampling signal using the data control signal DCS. The shift register part 461 outputs the sampling signal by sequentially shifting the source start pulse according to the source sampling clock.

The first level shifter 462 changes a voltage level of the second image data DATA2. Specifically, the first level shifter 462 amplifies the voltage level of the second image data DATA2 to a voltage level that the second circuit 460 can drive. According to one embodiment of the present disclosure, the first level shifter 462 transmits the second image data DATA2 having the amplified voltage level to the latch part 471 of the third circuit 470 mounted on the second IC 20.

The third circuit 470 converts the sampled second image data DATA2 into the source signals and outputs the source signals to the data lines DL of the display panel.

According to one embodiment of the present disclosure, the third circuit 470 includes the latch part 471, a second level shifter 472, a digital-to-analog converter 473, and a buffer part 474.

The latch part 471 sequentially samples and latches, by predetermined units, the second image data DATA2 amplified by the first level shifter 462 of the second circuit 460 according to the sampling signal. Specifically, the latch part 471 stores the second image data DATA2, which has the amplified voltage level and is received from the first level shifter 462 of the second circuit 460, in response to the sampling signal generated by the shift register part 461 of the first circuit 450. In this case, the second image data DATA2 may be R, G, and B data. The latch part 471 transmits the stored second image data DATA2 to the second level shifter 472.

The second level shifter 472 changes the voltage level of the latched second image data DATA2. Specifically, the second level shifter 472 amplifies the voltage level of the second image data DATA2 to a voltage level that the digital-to-analog converter 473 can drive. The second level shifter 472 transmits the second image data DATA2 having the amplified voltage level to the digital-to-analog converter 473.

The digital-to-analog converter 473 converts the second image data DATA2 having the amplified voltage level into the source signals that are analog signals. The digital-to-analog converter 473 transmits the source signals converted into analog signals to the buffer part 474.

The buffer part 474 outputs the source signals to the data lines. Specifically, the buffer part 474 buffers the source signals according to the source output enable signal generated by the timing control unit 410 and outputs the buffered source signals to the data lines.

According to one embodiment of the present disclosure, the number of wires between the second circuit 460, which includes the shift register part 461 and the first level shifter 462 and is mounted on the first IC 10, and the third circuit 470, which includes the latch part 471 and is mounted on the second IC 20, may be minimized. Since the number of wires connecting between the first level shifter 462 of the first IC 10 and the latch part 471 of the second IC 20 may be reduced, the number of wires between the first IC 10 and the second IC 20 may be minimized.

Hereinafter, the checksum data according to the embodiment of the present disclosure will be described in detail with reference to FIGS. 4 and 5.

Figure 4:
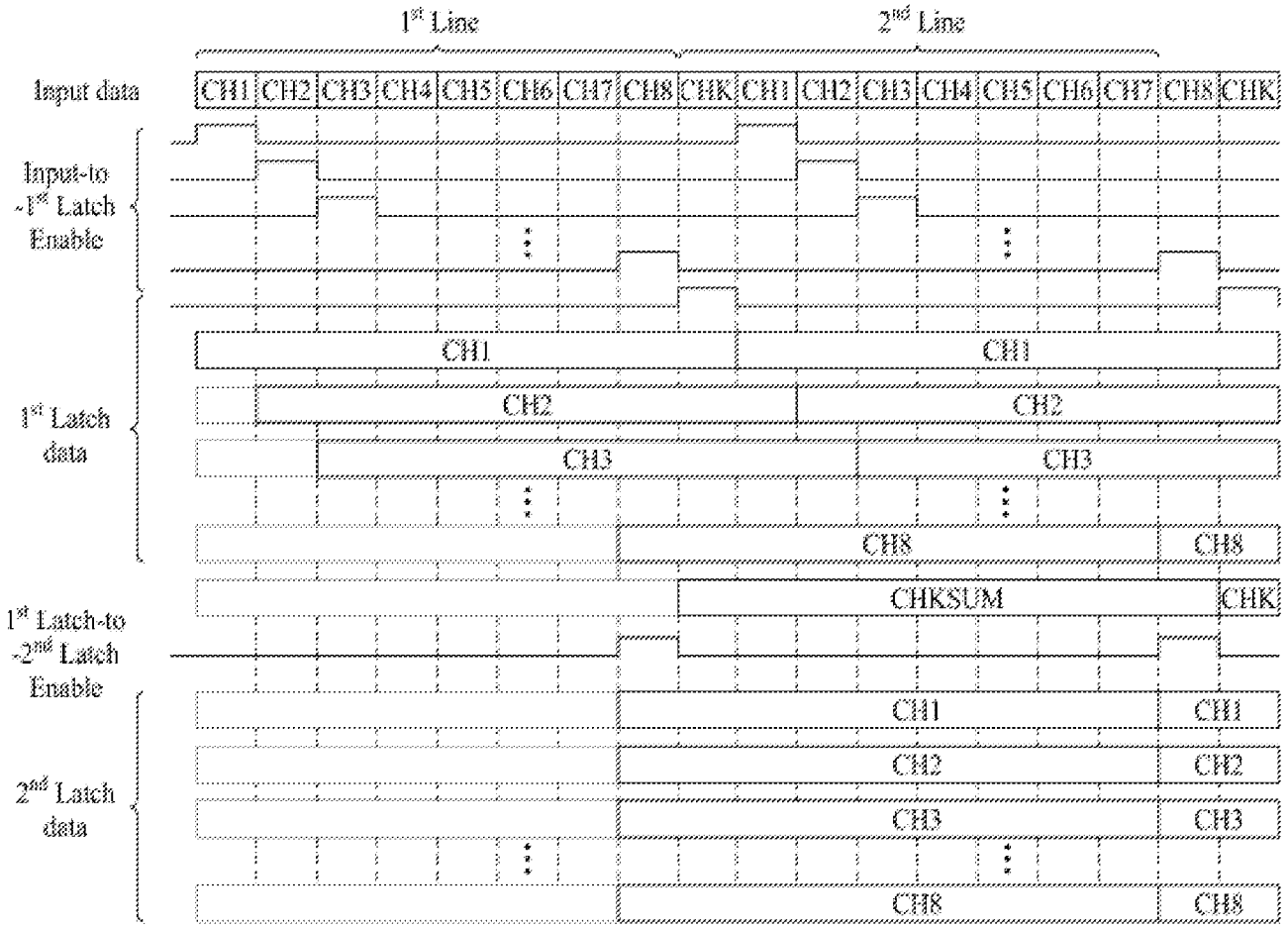
FIG. 4 is a diagram illustrating signal waveforms inside the driver IC according to one embodiment of the present disclosure.
Figure 5:
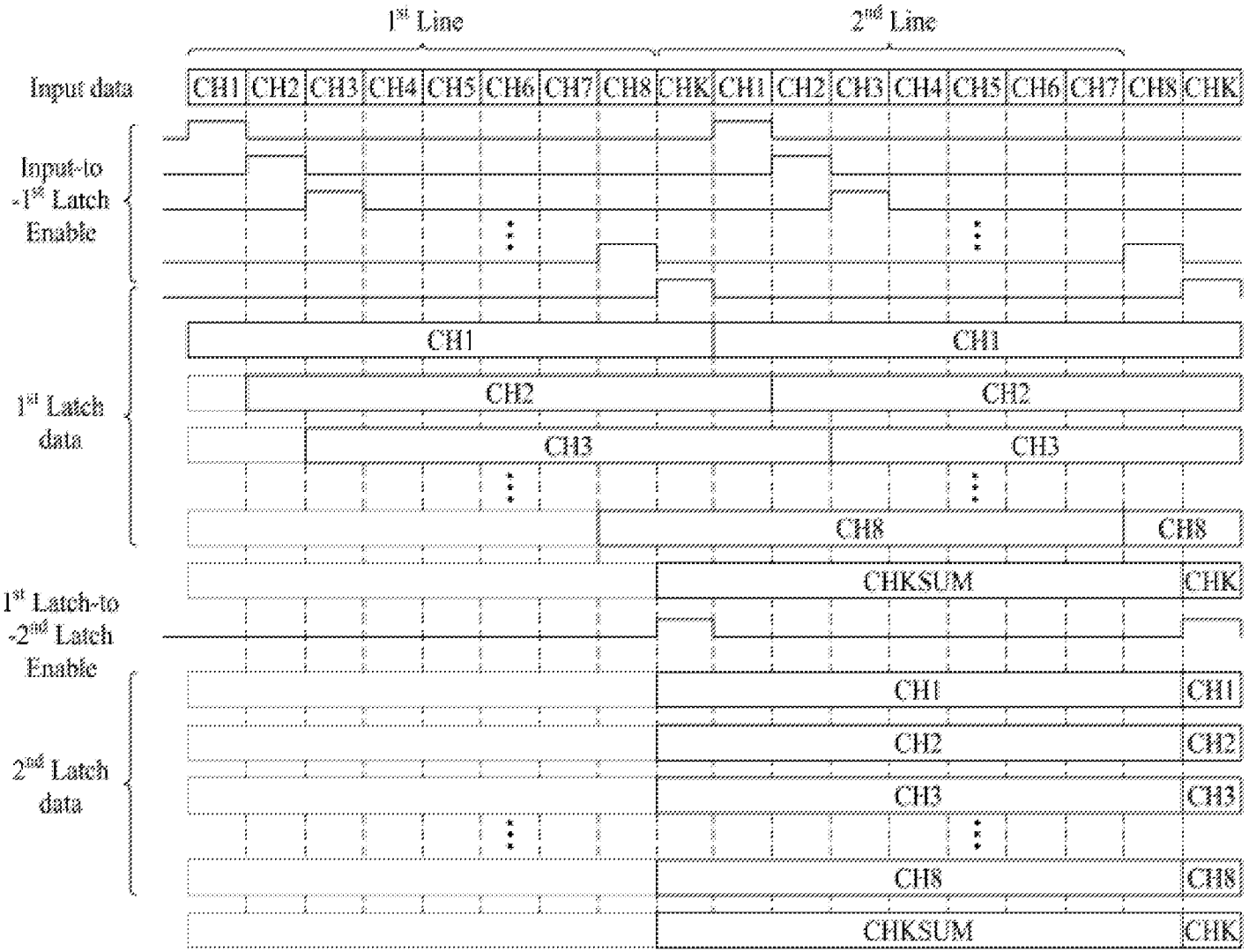
FIG. 5 is a diagram illustrating signal waveforms inside a driver IC according to another embodiment of the present disclosure.

FIG. 4 is a diagram illustrating signal waveforms inside the driver IC according to one embodiment of the present disclosure, and FIG. 5 is a diagram illustrating signal waveforms inside a driver IC according to another embodiment of the present disclosure.

As described above, the driver IC according to one embodiment of the present disclosure generates the checksum data CHKSUM for the second image data DATA2. The second image data DATA2 is composed of a plurality of pieces of horizontal line data, and one piece of horizontal line data is composed of first to eighth channel data CH1 to CH8.

The channel data CH1 to CH8 is sequentially stored in registers of the shift register part 461, respectively, according to the control signal of the timing control unit 410 enabling the shift register part 461 of the second circuit 460. In particular, as shown in FIGS. 4 and 5, after the first to eighth channel data CH1 to CH8 of one piece of horizontal line data is sequentially stored in the registers, respectively, the checksum data CHKSUM for the corresponding horizontal line data is stored in a register.

The channel data CH1 to CH8 is stored in latches of the latch part 471, respectively, in response to the control signal of the timing control unit 410 enabling the latch part 471 of the third circuit 470. In particular, as shown in FIGS. 4 and 5, after the first to eighth channel data CH1 to CH8 of one piece of horizontal line data is stored in the latches, respectively, the checksum data CHKSUM for the corresponding horizontal line data is stored in a latch.

Here, as shown in FIG. 4, the latch part 471 of the third circuit 470 may be enabled at the same time when the register, in which the eighth channel data CH8 is stored, is enabled among the registers of the shift register part 461 of the second circuit 460. Accordingly, when the register, in which the eighth channel data CH8 is stored, is enabled among the registers of the shift register part 461 of the second circuit 460 and thus the eighth channel data CH8 is stored, the first to eighth channel data CH1 to CH8 of one piece of horizontal line data may be stored in the latches, respectively.

Alternatively, as shown in FIG. 5, the latch part 471 of the third circuit 470 may be enabled at the same time when the register, in which the checksum data CHKSUM is stored, is enabled among the registers of the shift register part 461 of the second circuit 460. Accordingly, when the register, in which the checksum data CHKSUM is stored, is enabled among the registers of the shift register part 461 of the second circuit 460 and thus the checksum data CHKSUM is stored in the register, the first to eighth channel data CH1 to CH8 of one piece of horizontal line data may be stored in the latches, respectively.

Figure 6:
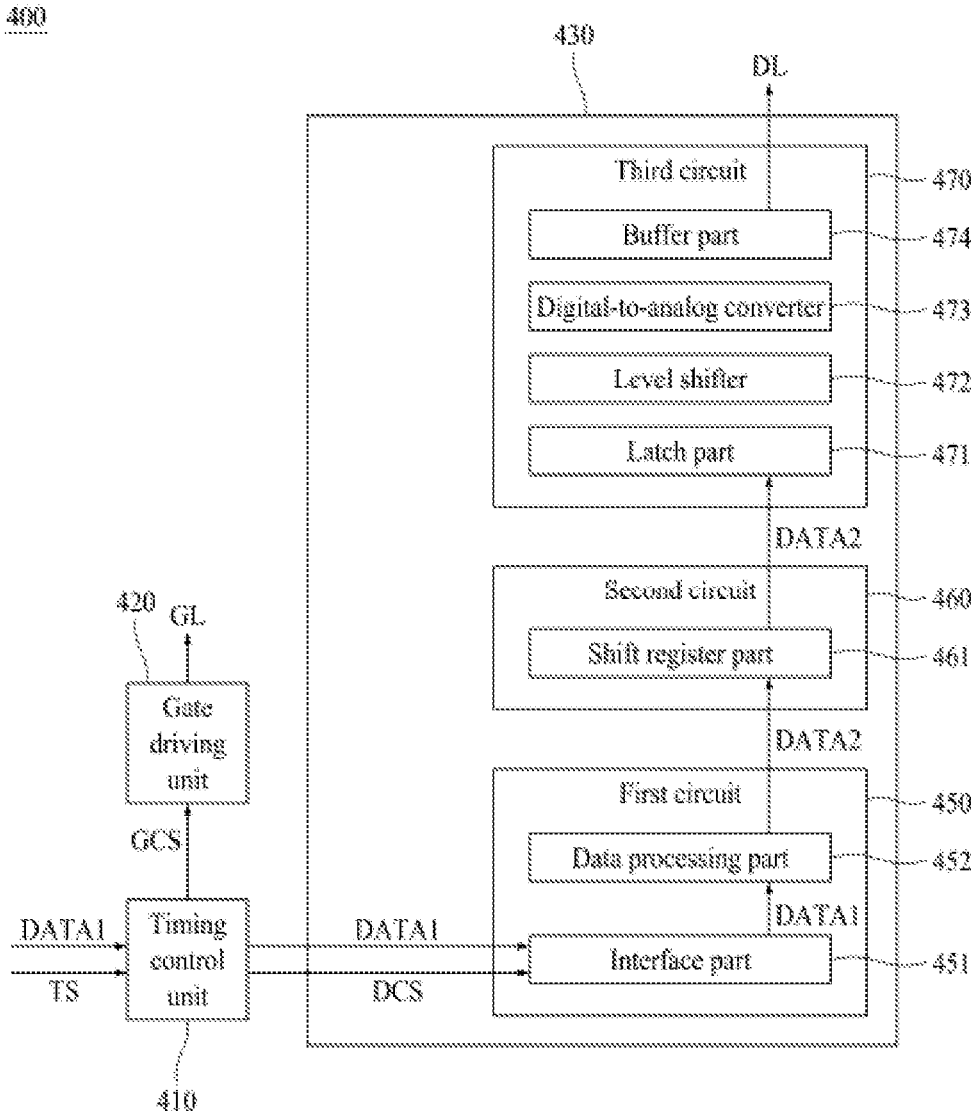
FIG. 6 is a schematic block diagram of the driver IC according to another embodiment of the present disclosure.
Figure 7:
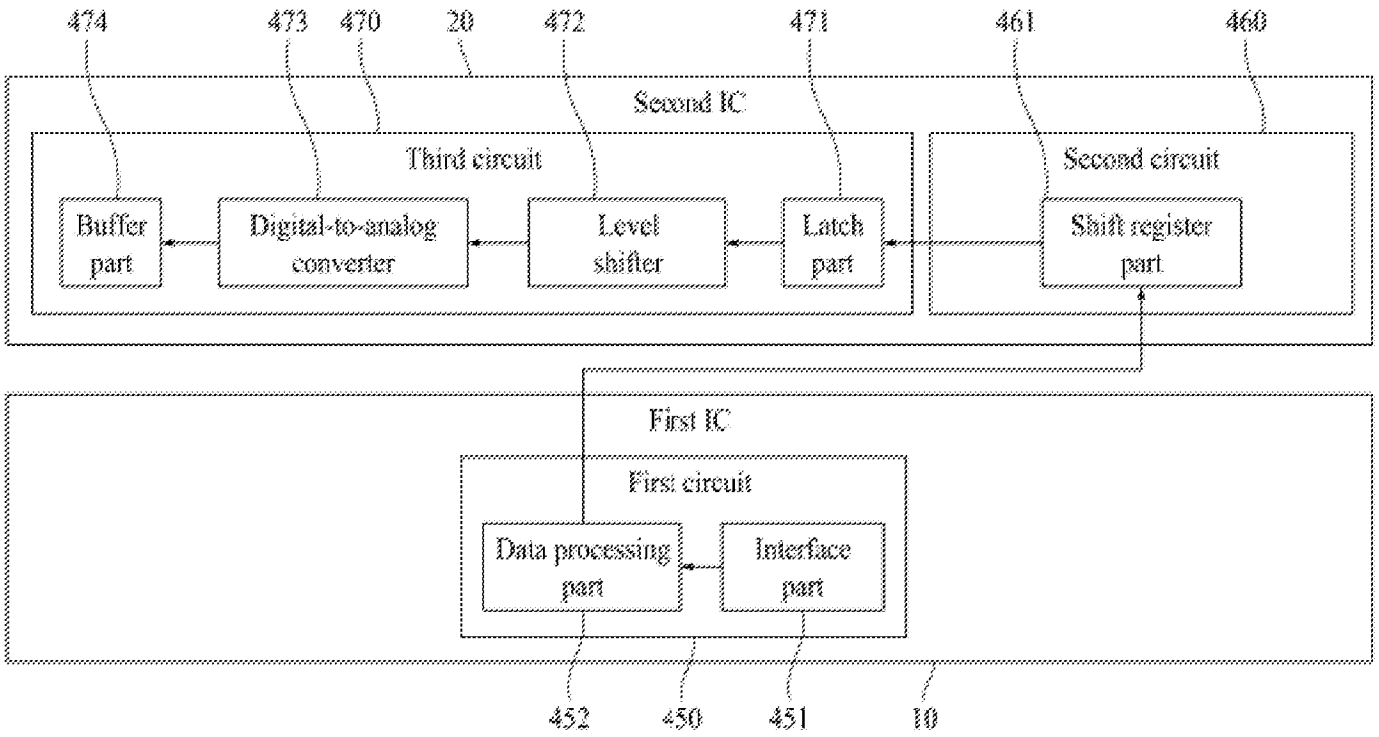
FIG. 7 is a diagram illustrating a structure of a data driving unit of the driver IC according to another embodiment of the present disclosure.

FIG. 6 is a schematic block diagram of the driver IC according to another embodiment of the present disclosure, and FIG. 7 is a diagram illustrating a structure of a data driving unit of the driver IC according to another embodiment of the present disclosure. Hereinafter, the driver IC according to another embodiment of the present disclosure will be described in detail with reference to FIGS. 6 and 7. Hereinafter, a detailed description will be omitted for the contents which are the same as those described above.

According to another embodiment of the present disclosure, as shown in FIG. 6, a data driving unit 430 includes a first circuit 450, a second circuit 460, and a third circuit 470.

According to another embodiment of the present disclosure, as shown in FIGS. 6 and 7, the data driving unit 430 includes the first circuit 450 located in a first IC 10, the second circuit 460 located in a second IC 20, and the third circuit 470 located in the second IC 20.

According to another embodiment of the present disclosure, as shown in FIG. 7, the first IC 10 and the second IC 20 may be combined with each other. Specifically, the first IC 10 and the second IC 20 may be combined by a method such as wire bonding using a wire, flip-chip bonding in which the connection is made through bumps, through-silicon-via (TSV) bonding, and the like.

According to another embodiment of the present disclosure, the data driving unit 430 includes the first circuit 450 configured to receive and process the first image data DATA1 to generate second image data DATA2, the second circuit 460 configured to generate sampled second image data DATA2 using the second image data DATA2 and the data control signal DCS, and the third circuit 470 configured to convert the sampled second image data DATA2 into source signals and transmit the source signals to the data lines DL of a display panel.

The first circuit 450 receives and processes the first image data DATA1 to generate the second image data DATA2, and transmits the generated second image data DATA2 to the second circuit 460.

According to another embodiment of the present disclosure, the first circuit 450 includes an interface part 451 and a data processing part 452.

The interface part 451 may perform interfacing on the signals and/or data which are transmitted and received between the timing control unit 410 and the data processing part 452. Specifically, the interface part 451 performs interfacing after receiving the first image data DATA1 transmitted from the timing control unit 410 and transmits the interfaced first image data DATA1 to the data processing part 452. Here, the first image data DATA1 may be R, G, and B data.

The interface part 451 may be an interface suitable for a serial interface, such as a Mobile Industry Processor Interface (MIPI®), a mobile display digital interface (MDDI), a DisplayPort, or an embedded DisplayPort (eDP).

The data processing part 452 generates the second image data DATA2 by correcting the first image data DATA1 transmitted from the interface part 451. In this case, the generated second image data DATA2 may be image data allowing the image quality of the display panel to be improved in comparison with the first image data DATA1. According to another embodiment of the present disclosure, the data processing part 452 transmits the generated second image data DATA2 to a shift register part 461 of the second circuit 460 mounted on the second IC 20.

According to another embodiment of the present disclosure, the data processing part 452 calculates checksum data CHKSUM for the second image data DATA2 and transmits the checksum data to the second circuit 460. According to another embodiment of the present disclosure, the loss of the image data may be minimized by correcting errors occurring during the transmission process of the image data using the checksum data CHKSUM.

According to another embodiment of the present disclosure, the second circuit 460 includes the shift register part 461.

The shift register part 461 controls the timing at which the second image data DATA2 is sequentially stored in a latch part 471 of the third circuit 470. Specifically, the shift register part 461 outputs a sampling signal using the data control signal DCS. The shift register part 461 outputs the sampling signal by sequentially shifting a source start pulse according to a source sampling clock. The shift register part 461 transmits the sampling signal to the latch part 471 of the third circuit 470.

The shift register part 461 receives the source start pulse and the source sampling clock from the timing control unit 410, and sequentially shifts the source start pulse according to the source sampling clock to output the sampling signal. The shift register part 461 transmits the sampling signal to the third circuit 470.

According to another embodiment of the present disclosure, the third circuit 470 includes the latch part 471, a level shifter 472, a digital-to-analog converter 473, and a buffer part 474.

According to another embodiment of the present disclosure, the number of wires between the first circuit 450, which includes the interface part 451 and the data processing part 452 and is mounted on the first IC 10, and the second circuit 460, which includes the shift register part 461 and is mounted on the second IC 20, may be minimized. Since the number of wires connecting between the data processing part 452 of the first IC 10 and the shift register part 461 of the second IC 20 may be reduced, the number of wires between the first IC 10 and the second IC 20 may be minimized.

According to the present disclosure, circuits constituting a driver IC are divided and formed in two integrated circuits, and both integrated circuits are combined, so that a driver IC can be miniaturized, and thus there is an effect that the size of a bezel of a display device on which the corresponding driver IC is mounted can be reduced.

Further, according to the present disclosure, a driver IC is manufactured through a wafer-on-wafer process, so that the number of masks required for each wafer can be reduced, and thus there is an effect that the costs of manufacturing the driver IC can be minimized.

Further, according to the present disclosure, the loss of image data can be reduced, so that there is an effect that the image quality of a display device can be improved.

In addition, according to the present disclosure, there is an effect that the number of wires for image data can be minimized.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A driver integrated circuit (IC) comprising:

a first IC;

a second IC that is combined with the first IC;

a first circuit configured to receive first image data, and generate second image data by correcting the first image data;

a second circuit configured to sample the second image data; and a third circuit configured to convert the sampled second image data into a source signal, wherein the first circuit is mounted on the first IC, the second circuit is mounted on one of the first IC and the second IC, and the third circuit is mounted on the second IC.

2. The driver IC of claim 1, wherein the second circuit is mounted on the first IC and includes a shift register part configured to receive a source start pulse and a source sampling clock, and output a sampling signal by sequentially shifting the source start pulse according to the source sampling clock, and a first level shifter configured to amplify a voltage level of the second image data.

3. The driver IC of claim 1, wherein the second circuit is mounted on the second IC and includes a shift register part configured to receive a source start pulse and a source sampling clock, and output a sampling signal by sequentially shifting the source start pulse according to the source sampling clock.

4. The driver IC of claim 1, wherein the third circuit includes:

a latch part configured to sequentially sample and latch the sampled second image data by predetermined units;

a second level shifter configured to amplify a voltage level of the latched second image data;

a digital-to-analog converter configured to convert the amplified second image data into the source signal that is an analog signal; and a buffer part configured to buffer the source signal according to a source output enable signal generated by a timing control circuit and output the buffered source signal to a display panel.

5. The driver IC of claim 1, wherein the first circuit includes a data processing part configured to receive the first image data, and transmit the second image data by processing the first image data.

6. The driver IC of claim 5, wherein the first circuit calculates and transmits checksum data for the second image data.

7. The driver IC of claim 5, wherein the second circuit includes a shift register part configured to receive a source start pulse and a source sampling clock, and output a sampling signal by sequentially shifting the source start pulse according to the source sampling clock, and the shift register part includes a register configured to store checksum data for the second image data.

8. The driver IC of claim 5, wherein the third circuit includes a latch part configured to sequentially sample and latch the sampled second image data, and the latch part includes a latch configured to store checksum data for the second image data.

9. The driver IC of claim 1, wherein the first IC and the second IC are combined by one among wire bonding, flip-chip bonding, and through-silicon-via bonding.

10. The driver IC of claim 1, wherein the driver IC is a driver IC for driving a display that outputs an image signal to a display panel.

11. A display device comprising a data driving unit configured to transmit a source signal to a data line of a display panel, wherein the data driving unit includes:

a first integrated circuit (IC);

a second IC that is combined with the first IC;

a first circuit configured to receive first image data, and generate second image data by correcting the first image data;

a second circuit configured to sample the second image data; and a third circuit configured to convert the sampled second image data into a source signal and transmit the source signal to the data line, wherein the first circuit is mounted on the first IC, the second circuit is mounted on one of the first IC and the second IC, and the third circuit is mounted on the second IC.

12. The display device of claim 11, wherein the second circuit is mounted on the first IC and includes a shift register part configured to receive a source start pulse and a source sampling clock, and output a sampling signal by sequentially shifting the source start pulse according to the source sampling clock, and a first level shifter configured to amplify a voltage level of the second image data.

13. The display device of claim 11, wherein the second circuit is mounted on the second IC and includes a shift register part configured to receive a source start pulse and a source sampling clock, and output a sampling signal by sequentially shifting the source start pulse according to the source sampling clock.

14. The display device of claim 11, wherein the third circuit includes:

a latch part configured to sequentially sample and latch the sampled second image data by predetermined units;

a second level shifter configured to amplify a voltage level of the latched second image data;

a digital-to-analog converter configured to convert the amplified second image data into the source signal that is an analog signal; and a buffer part configured to buffer the source signal according to a source output enable signal generated by a timing control circuit and output the buffered source signal to the display panel.

15. The display device of claim 11, wherein the first circuit includes a data processing part configured to receive the first image data, and transmit the second image data by processing the first image data.

16. The display device of claim 15, wherein the first circuit calculates and transmits checksum data for the second image data.

17. The display device of claim 11, wherein the first IC and the second IC are combined by one among wire bonding, flip-chip bonding, and through-silicon-via bonding.

* * * * *